US005350559A

United States Patent [19]

Miyazaki et al.

[11] Patent Number: 5,350,559

[45] Date of Patent: Sep. 27, 1994

[54] FERRITE STEEL WHICH EXCELS IN HIGH-TEMPERATURE STRENGTH AND TOUGHNESS

[75] Inventors: Astushi Miyazaki; Takumi Ujiro; Fusao Togashi, all of Chiba, Japan

[73] Assignee: Kawasaki Steel Corporation, Japan

[21] Appl. No.: 106,423

[22] Filed: Aug. 13, 1993

[51] Int. Cl.[5] ..... C22C 38/26; C22C 38/30

[52] U.S. Cl. ..... 420/36; 420/70

[58] Field of Search ..... 420/36, 70; 148/325

[56] References Cited

U.S. PATENT DOCUMENTS 3,499,802 3/1970 Lagneborg ..... 420/36

FOREIGN PATENT DOCUMENTS 55-138057 10/1980 Japan ..... 420/36

*Primary Examiner*—Deborah Yee

*Attorney, Agent, or Firm*—Austin R. Miller

[57] ABSTRACT

A ferrite steel suitable for use as the material of a part which is used at high and which is required to have high toughness at weld heat affected zones. The ferrite steel has a composition which contains C: not more than 0.02 wt %, Si: not more than 2.0 wt %, Mn: not more than 1.0 wt %, Cr: not less than 6.0 wt % but not more than 23.0 wt %, Ni: not more than 1.0 wt %, Nb: not less than 0.4 wt % but not more than 0.65 wt %, Co: not less than 0.01 wt % but not more than 2.0 wt %, Al: not more than 0.5 wt %, N: not more than 0.03 wt % and the balance substantially Fe and incidental inclusions.

18 Claims, 2 Drawing Sheets

FERRITE STEEL WHICH EXCELS IN HIGH-TEMPERATURE STRENGTH AND TOUGHNESS

BACKGROUND OF THE INVENTION

1. Field of the Invention

The present invention relates to a ferrite steel which excels in high-temperature strength and also in toughness in weld heat affected zones.

2. Description of the Related Art

Hitherto, ferrite steels have been widely used as a heat- and acid-resistant material, due to the fact that such steels have the following advantages (1) to (3) over austenitic steels.

(1) Ferrite steel in general has a small thermal expansion coefficient and excels in characteristics under such conditions in which it undergoes repeated heating cycles, i.e., superior in resistance to thermal fatigue and resistance to repeated oxidation.

(2) Ferrite steel is easy to bond to other parts (steel or cast iron).

(3) Ferrite steel is comparatively inexpensive.

It is to be understood, however, that ferrite steel is generally inferior to austenitic steel in high temperature strength and workability of welded portions, so that this type of steel has only limited uses. Namely, ferrite steel cannot suitably be adopted in uses which require particularly high strength at high temperatures and good workability of weld portions.

For instance, in the field of automotive parts, exhaust pipes are required to sustain high temperatures well exceeding 850° C., sometimes 900° C. or higher, in order to meet the demand for higher engine performance, i.e., demands for increases in engine output power and reduced fuel consumption.

Construction and configuration of exhaust pipes also are becoming complicated, posing a risk of embrittlement cracking at welded parts due to inferior workability of the welded part, during working for realizing such complicated configurations. In general, workability is reduced when the strength is increased. Increases in strength alone cannot provide materials suitable for use as exhaust pipe materials.

Referring now to the base metal of such steels, remarkable improvement has been achieved in recent years due to reduction in C and N contents and addition of stabilizing elements such as Nb and Ti. When a metal is subjected to welding, the toughness of the portion which is molten by welding heat can appreciably be improved by suitable selection of the welding rod material. However, the toughness of the heat affected zone of the base metal is substantially influenced by the composition of the base metal. Therefore, it has been extremely difficult to develop a material which simultaneously exhibits large high-temperature strength and high toughness of the heat affected zone.

Hitherto, various materials have been proposed to cope with such a problem. For instance, Japanese Patent Publication No. 1-41694 discloses that creep characteristics can be improved by addition of Nb in excess of a predetermined amount, i.e., by making the material contain an effective amount of Nb. It is understood that the material proposed in this Japanese Patent Publication is improved also in high-temperature strength. This material would be suitably employed for use which does not require a specifically high level of toughness at the weld portion. Thus, the above-mentioned Japanese Patent Publication fails to teach or suggest improvement in toughness.

Japanese Patent Laid-Open No. 57-85960 discloses an Nb-containing ferrite steel. The art disclosed in this Laid-Open specification appreciably improves toughness of the ferrite steel but does not give specific consideration to the improvement of high-temperature strength. In fact, in this Laid-Open specification, the content of Nb, which is an element important for attaining improvement in high-temperature strength, is limited to be not more than 0.45 wt % (last line, page 12 to line 1, page 13) from the view point of toughness, preferably between 0.25 and 0.4 wt %. When the above-mentioned upper limit of Nb content is exceeded, toughness of the steel is drastically reduced as shown in FIG. 2 of this application. In addition, the above-mentioned Laid-Open specification states that the Al content is preferably 0.5 wt % or less from the view point of toughness.

In general, when Nb content exceeds a chemical stoichiometric value for bonding to C and N expressed by ($C\times93/12+N\times93/14$), Nb is preferentially bonded to C and N so that Al exists in a dissolved state. As well known to those skilled in the art, dissolved Al impairs workability and toughness.

Japanese Patent Laid-Open No. 56-25953 discloses a ferrite steel which excels in resistance to high-temperature oxidation and creep, as well as in weldability. The steel shown in this Laid-Open specification essentially contains Al by an amount not less than 0.5 wt % in order to exhibit improved resistance to oxidation. It is stated, however, that the Al content should not exceed 2 wt %, because Al adversely affects weldability (line 14, page 17). Thus, the art disclosed in this Laid-Open specification gives a preference to improvement in the oxidation resistance at high temperature and proposes to add Al by an amount not less than 0.5 wt % even though addition of Al is not desirable.

OBJECT OF THE INVENTION

Accordingly, an object of the present invention is to provide an improved ferrite steel which exhibits improved toughness of heat affected zones without impairing high-temperature strength, despite containment of about 0.4 wt % or more of Nb which drastically reduces toughness at heat affected zones, thus realizing a ferrite steel which can suitably be used as a material for parts which are required to sustain use at high temperatures.

In other words, the object of the present invention is to provide a ferrite steel which exhibits sufficient strength even at high temperature exceeding 900° C. and which shows high toughness even at portions which have thermal hysteresis, such as heat affected zones.

SUMMARY OF THE INVENTION

The present inventors have conducted various experiments and studies on the problems mentioned before, i.e., difficulty in simultaneously attaining both high-temperature strength and high toughness at heat affected zone. As a result, the inventors have found that toughness at heat affected zones of Nb-containing ferrite steel can be remarkably improved without being accompanied by deterioration in other properties, when Co is added to such a steel, thus accomplishing the present invention.

According to the present invention, there is provided a ferrite steel having a composition which essentially consists of C: not more than about 0.02 wt %, Si: not more than about 2.0 wt %, Mn: not more than about 1.0 wt %, Cr: not less than about 6.0 wt % but not more than about 23.0 wt %, Ni: not more than about 1.0 wt %, Nb: not less than about 0.4 wt % but not more than about 0.65 wt %, Co: not less than about 0.01 wt % but not more than about 2.0 wt %, Al: not more than about 0.5 wt %, N: not more than about 0.03 wt % and the balance substantially Fe and incidental inclusions.

The ferrite steel of the invention also may contain one, two or more of not more than about 2.5 wt % of Mo, not more than about 0.5 wt % of Ti and/or Zr and not more than about 0.1 wt % of REM (rare earth metals).

The above and other objects, features and advantages of the present invention will become clear from the following description of the invention.

DETAILED DESCRIPTION OF THE INVENTION

Figure 1:
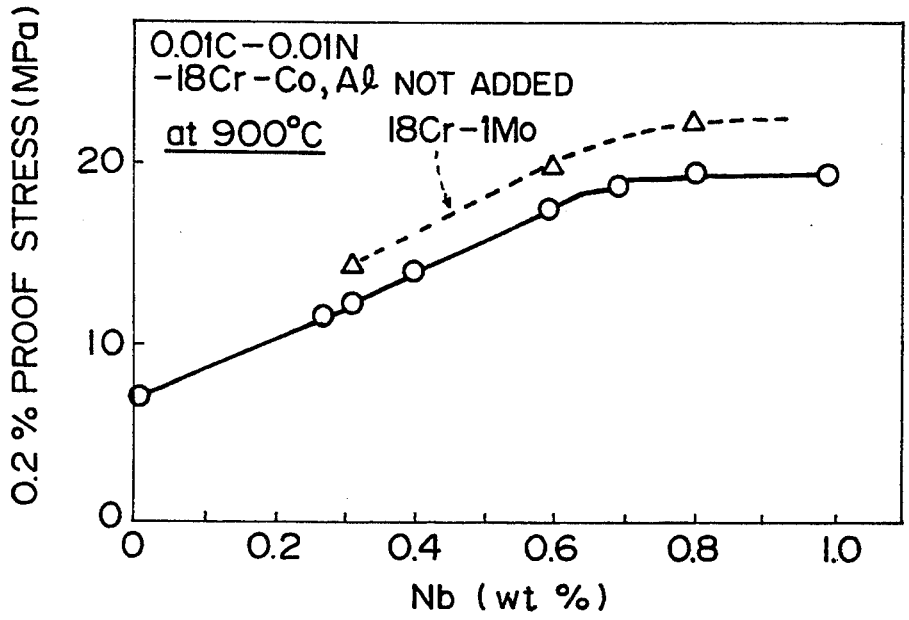
FIG. 1 is a graph showing the relationship between Nb content and high-temperature strength at 900° C. of a 18Cr ferrite steel.

The present inventors have found that the reduction in the heat affected zone caused by the presence of more than 0.4 wt % of Nb is attributable to the presence of an intermetallic compound $Fe_2Nb$ which tends to precipitate particularly at a temperature range between 600° and 800° C. Usually, ferrite steels have been finish-annealed at a temperature of 900° C. or higher and a substantially equilibrium state of precipitation has been attained, so that the intermetallic compound $Fe_2Nb$ does not materially exist or exists only in a trace amount. In addition, C and N have been fixed by being bonded to Nb, i.e., by forming Nb(C,N). However, when the ferrite steel is subjected to heating at high temperature such as in welding, C and N are freed from Nb so that Nb, C and N are independently dissolved. During a subsequent cooling, non-equilibrium or competition of precipitation takes place between Nb(C, N) and $Fe_2Nb$. When the Nb content is large, $Fe_2Nb$, which did not exist in the as annealed material, is precipitated so as to cause embrittlement of the ferrite steel.

The reason why the toughness of the heat affected zone is improved by the addition of Co has not been theoretically clarified yet. It is, however, considered that, when the Nb content falls within the specified range, Co produces an effect to retard precipitation of $Fe_2Nb$, i.e., an effect to suppress precipitation of $Fe_2Nb$ while allowing preferential precipitation of Nb(C,N) during the cooling after application of heat, thus improving toughness of the heat-affected zone.

A description will now be given for the reasons of limiting the contents of the respective elements. C: not more than 0.02 wt %

C produces an undesirable effect on the toughness of weld heat affected zones. The presence of C, however, does not produce any practical problem provided that its content is about 0.02 wt % or less, because toughness is remarkably improved by addition of Co alone or in combination with Al as will be described later. The C content is preferably about 0.01 wt % or less where the demand for improvement in the toughness is specifically high. From the view point of improvement in high-temperature strength, the C content is preferably small. Si: not more than about 2.0 wt %

Si is an element which is effective in improving oxidation resistance. Oxidation resistance is mainly determined by the balance between Cr and Si. An increase in the Si content causes a reduction in workability, but such a reduction can be suppressed by reducing the Cr content. In the presence of about 6.0 wt % of Cr, Si content of about 2.0 wt % is enough for simultaneously attaining workability and oxidation resistance at a high temperature of about 900 ° C. which is required for the materials of parts of an exhaust system for an engine. The Si content, therefore, is limited not to exceed about 2.0 wt %. Mn: not more than about 1.0 wt %

The Mn content is preferably small from the view point of workability, but the presence of Mn up to about 1.0 wt % is permissible when production cost is considered. Cr: not less than about 6 wt % but not more than about 23 wt %

Cr is a principal element for providing oxidation resistance. This effect, however, is not appreciable at a high temperature of 900° C. or so when the Cr content is below about 6 wt % even in the presence of about 2 wt % of Si which is the upper limit of the Si content. On the other hand, a Cr content exceeding about 23 wt % causes a serious reduction in the toughness of the heat affected zones. Ni: not more than about 1.0 wt %

Ni is an austenite former and contributes to improvement in workability. A too large Ni content, however, adversely affects the stabilization of the ferrite phase. The Ni content, therefore, is limited to a level not more than about 1.0 wt %. Nb: not less than about 0.4 wt % but not more than about 0.65 wt %

Figure 2:
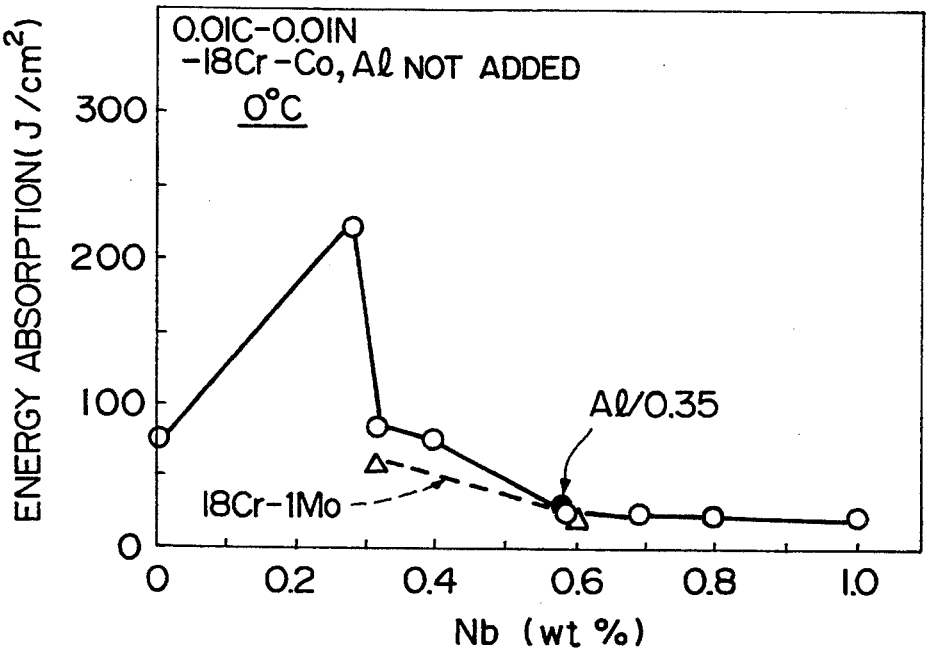
FIG. 2 is a graph showing the relationship between Nb content of a 18Cr ferrite steel and the toughness (0° C. Charpy energy absorption) of a material equivalent to a weld heat affected zone (10-minute heating at 1250° C. followed by air cooling) of the 18Cr ferrite steel.

Nb contributes to improvement in high-temperature strength as shown in FIG. 1. This effect, however, is saturated when the Nb content is increased beyond about 0.65wt %. The upper limit of the Nb content, therefore, is set to be about 0.65 wt %. On the other hand, an increase in the Nb content impairs the toughness of the heat affected zone, as shown in FIG. 2. In particular, energy absorption at 0° C. is reduced to 80 $J/cm^2$ or less when the Nb content is about 0.4 wt % or more. Working effected on a welded part of a steel member having such a high Nb content, particularly in the winter season, tends to cause embrittlement cracking at heat affected zones, thus posing a serious problem. This problem is not overcome by addition of Mo nor by the addition of Al. It is to be noted, however, that the toughness of heat affected zones can be increased so that energy absorption can be increased to 80 $J/cm^2$ or greater even when the Nb content exceeds about 0.4 wt %, by the addition of a proper amount of Co alone or in combination with Al, as will be seen from FIG. 3. The present invention is aimed at suppressing reduction in the toughness of heat affected zones while high-temperature strength is increased. Thus, the present invention pertains to a ferrite steel which has a Nb content not less than about 0.4wt %. In other words, the lower limit of the Nb content of the steel according to the invention is set to be about 0.4 wt %. Co: not less than about 0.01 wt % but not more than about 2.0 wt %

Figure 3:
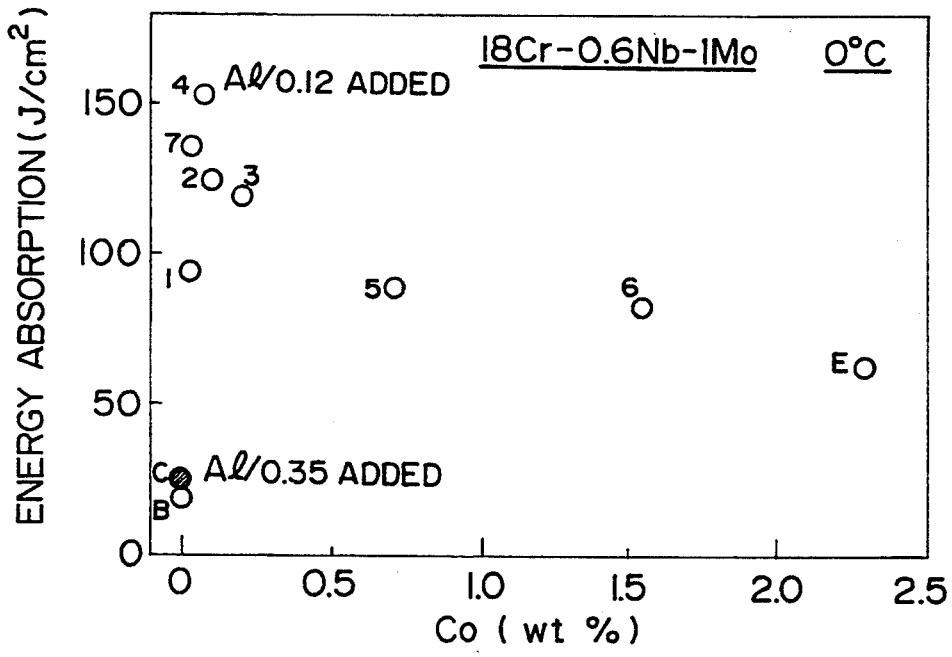
FIG. 3 is a graph showing the relationship between Co content and the toughness (0° C. Charpy energy absorption) of a material equivalent to a weld heat affected zone (10-minute heating at 1250° C. followed by air cooling)
Figure 4:
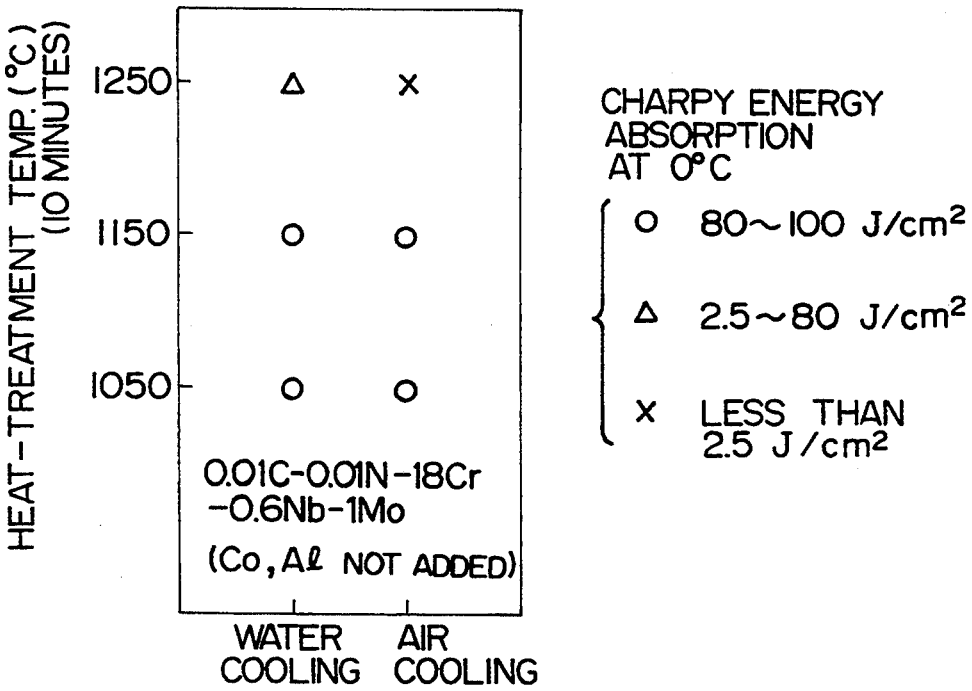
FIG. 4 is a graph showing the values of 0° C. Charpy energy absorption as measured on samples of a basic steel (0.01C—0.01N-18Cr—0.6Nb—1Mo) after 10-minute heating at 1050° C., 1150° C. and 1250° C., respectively, followed by water or air cooling, the energy absorption values being average values of three test pieces of each sample (n=3).

Co is added for the purpose of suppressing the reducing tendency of toughness at heat affected zones caused by the presence of Nb. As will be seen from FIG. 3, addition of Co, even when the content is as small as 0.01 wt %, causes an increase in energy absorption to 80 J/cm$^2$, which is much greater than that exhibited when Co is not present. The effect to improve toughness is maximized when the Co content is about 0.1 wt %, and is further enhanced when Al is added simultaneously with the addition of Co. Referring to FIG. 3, a steel Sample No. 4 (Co/0.08,Al/0.12) exhibits a greater toughness of weld heat affected zone than a steel Sample No. 2 (Co/0.10, Al/0.009). Addition of Co provides sufficiently high toughness of heat affected zones even when the Co content is 1.5 wt %. Addition of Co in excess of a certain amount, e.g., 2.3 wt %, does not cause an appreciable increase in the toughness of heat affected zones. In view of this fact, as well as the high price of Co, the upper limit of the Co content is set to be about 2.0wt %. The lower limit is set to about 0.01 wt % because a Co content below this value does not produce an appreciable effect. Preferably, the Co content is not less than 0.04 wt % but not more than about 0.5 wt %. Al: not more than about 0.5 wt %

This element may be added in order to enhance the effect produced by Co to improve toughness at weld heat affected zones. As stated before, the main cause of reduction in the toughness at heat affected zones is the precipitation of $Fe_2Nb$. Addition of Co is essential for suppressing precipitation of $Fe_2Nb$. The effect to improve toughness at heat affected zones is enhanced when Al is contained in addition to Co. Addition of Al without Co does not produce any remarkable effect in improving toughness of heat affected zones which have been reduced due to the presence of Nb, as will be seen from FIGS. 2 and 3 (Al/0.35). That is to say, Al alone can produce only a small effect in retarding precipitation of $Fe_2Nb$. Thus, addition of Al is ineffective unless Co is added. Addition of Al in excess of 0.5wt %, however, impairs workability. The Al content, therefore, is determined to be about 0.5 wt % or less. N: not more than about 0.03 wt %

This element enhances strength at high temperatures but adversely affects toughness as is the case of C. The presence of N, however, does not cause practical problems when the N content is about 0.03 wt % or less. Mo: not more than about 2.5 wt %

Mo may be added as it improves high-temperature strength as shown in FIG. 1. Addition of Mo in excess of about 2.5 wt %, however, causes a serious reduction in the toughness of the heat affected zones. The upper limit of Mo content, therefore, is set to be about 2.5 wt %. One or both of Ti and Zr: not more than about 0.5 wt %

Addition of Zr and/or Ti to Nb-containing steel produces an effect to lower the recrystallization temperature, over steels which do not contain such elements, thus contributing to improvements in producibility. These elements, however, are expensive so that the content or contents are limited to e about 0.5 wt % or less. REM: not more than about 0.1 wt %

REM is a general expression of Sc, Y and lanthanide series elements such as La and Ce. These elements may be added when specifically high oxidation resistance is required. The presence of these elements in excessive amounts, however, deteriorates hot workability. The contents of these elements, therefore, is limited to be about 0.1 wt % or less.

EXAMPLES

Examples of the ferrite steel in accordance with the present invention will be described hereunder.

Steel sheets 2.0 mm thick were obtained from 30 Kg steel slabs of various compositions as shown in Table 1, through hot rolling, annealing, cold rolling and annealing, samples or test pieces of such sheets were subjected to examinations for evaluation of high-temperature tensile strength, toughness of heat affected zones and recrystallization temperature, as well as to an oxidation test. The results are shown in Table 2.

The conditions of the examinations and test were as follows:

(1) High-Temperature Tensile Test

Tabular test pieces 2.0 mm thick were subjected to a tensile test which was conducted at 900° C. by stretching the test piece at a rate of 0.3 %/minute, and 0.2 % proof stress was measured for each test piece.

(2) Evaluation of Toughness of Heat Affected Zones

The level of energy absorption at 0° C. of an actual TIG weld heat affected zone of 18Cr—0.6Nb—1Mo steel (Co not added) was measured to be 25 J/cm$^2$ or less. This material also was subjected to a heat treatment conducted under various conditions. As a result, it was found that the above-mentioned level of energy absorption, i.e., toughness, is equivalent to that obtained when the same material is heated 10 minutes at 1250° C. followed by air cooling. Therefore, the toughness of heat affected zones was evaluated in terms of the level of energy absorption at 0° C. as measured on each test piece after 10-minutes of heating at 1250° C. followed by cooling in air. For the purpose of introduction of a safety factor to enable evaluation from a practical point of view, the measured levels of 0° C. energy absorption were classified into three groups: namely, below 80 J/cm$^2$ (marked by x), from 80 to 150 J/cm$^2$ (marked by o) and above 150 J/cm$^2$ (marked by]t).

(3) Measurement of Recrystallization Temperature

Test pieces 2.0 mm thick were subjected to cold rolling, followed by finish annealing which was conducted at 950° C., 970° C. and 1000° C., respectively. The structures of the test pieces were observed in the rolling direction to confirm whether recrystallization has been completed.

(4) Oxidation Test

Test pieces 2 mm thick, 20 mm wide and 30 mm long were prepared and surfaces of these test pieces were polished by #320 abrasive. The test pieces were then subjected to 500 heat cycles each consisting of 30-minutes of heating at high temperature (900° C.) in the and 30-minutes of cooling in atmospheric air. Changes in the weights (W mg/cm$^2$) of the test pieces were measured and evaluated by the following criteria.

]t |W| <2 mg/cm$^2$, o: 2<|W|<5, x: 5<|W|

Table 2 shows the results of the examinations and test conducted on the steel compositions shown in Table 1. As will be seen from FIG. 2, all the samples having Nb contents of 0.4 wt % or more and having thermal hysteresis equivalent to a heat affected zone exhibited Charpy energy absorption below 80 J/cm$^2$ at 0° C. However, toughness could be appreciably improved without being accompanied by deterioration in oxidation resistance and high-temperature strength, as proved by the steels of the invention (Steel Sample Nos. 1, 2, 3, 4, 5, 6 and 7), as shown in FIG. 3 and Table 2. In particular, the best effect of improvement in toughness could be obtained when the Co content was around 0.1 wt %.

On the other hand, comparison steel Samples A, D and E, which contain Nb, N and Co, respectively, in excess of the range specified by the present invention, failed to provide sufficient toughness. In particular, comparison steel Sample A, which contained 1.59wt % of Nb, exhibited inferior characteristics. This is considered to be attributable to the fact that precipitation of $Fe_2Nb$ could not be suppressed sufficiently due to too a large content of Nb.

As will be understood from the foregoing description, according to the present invention, it is possible to obtain a ferrite steel which excels in toughness of heat affected zones and which has enhanced high-temperature strength. Thus, the ferrite steel of the present invention can suitably be employed as the material of various parts which are used at high temperatures and which are required to have high toughness at weld heat affected zones, such as exhaust pipes of engines, combustors, and so forth.

TABLE 1

| No. | Chemical Composition (wt %) | | | | | | | | | | | | | |
|---|---|---|---|---|---|---|---|---|---|---|---|---|---|---|
| | C | Si | Mn | Cr | Ni | Nb | Al | Mo | Co | N | Ti | Zr | La | Ce |
| | STEEL OF INVENTION | | | | | | | | | | | | | |
| 1 | 0.010 | 0.69 | 0.44 | 19.1 | 0.13 | 0.58 | 0.009 | 0.91 | 0.03 | 0.014 | — | — | — | — |
| 2 | 0.015 | 0.83 | 0.33 | 18.8 | 0.14 | 0.63 | 0.007 | 0.83 | 0.10 | 0.008 | — | — | — | — |
| 3 | 0.011 | 0.83 | 0.35 | 18.1 | 0.14 | 0.61 | 0.041 | 0.84 | 0.19 | 0.015 | — | — | — | — |
| 4 | 0.011 | 0.71 | 0.49 | 18.3 | 0.21 | 0.59 | 0.122 | 0.91 | 0.08 | 0.014 | — | — | — | — |
| 5 | 0.007 | 0.33 | 0.30 | 18.1 | 0.07 | 0.59 | 0.131 | 0.75 | 0.71 | 0.004 | — | — | — | — |
| 6 | 0.013 | 0.39 | 0.33 | 18.5 | 0.08 | 0.58 | 0.101 | 0.81 | 1.54 | 0.011 | — | — | — | — |
| 7 | 0.009 | 0.51 | 0.41 | 17.8 | 0.03 | 0.59 | 0.042 | 0.003 | 0.05 | 0.013 | — | — | — | — |
| 8 | 0.014 | 1.89 | 0.58 | 6.1 | 0.03 | 0.57 | 0.005 | 0.001 | 0.07 | 0.015 | — | — | — | — |
| 9 | 0.009 | 0.59 | 0.41 | 17.0 | 0.11 | 0.55 | 0.021 | 0.85 | 0.02 | 0.007 | 0.05 | — | — | — |
| 10 | 0.009 | 0.30 | 0.53 | 18.5 | 0.11 | 0.62 | 0.154 | 1.10 | 0.12 | 0.008 | — | 0.24 | — | — |
| 11 | 0.005 | 0.71 | 0.41 | 17.3 | 0.21 | 0.59 | 0.013 | 0.99 | 0.07 | 0.015 | — | — | 0.03 | 0.02 |
| | COMPARISON STEEL | | | | | | | | | | | | | |
| A | 0.018 | 0.31 | 0.41 | 18.3 | 0.11 | 1.59 | 0.211 | 0.88 | 0.15 | 0.009 | — | — | — | — |
| B | 0.002 | 0.34 | 0.43 | 20.5 | 0.07 | 0.61 | 0.003 | 1.15 | 0.005 | 0.004 | — | — | — | — |
| C | 0.009 | 0.35 | 0.41 | 19.8 | 0.15 | 0.59 | 0.353 | 1.11 | 0.004 | 0.021 | — | — | — | — |
| D | 0.015 | 1.91 | 0.41 | 10.5 | 0.02 | 0.65 | 0.094 | 2.31 | 0.10 | 0.033 | — | — | — | — |
| E | 0.013 | 0.51 | 0.41 | 19.3 | 0.04 | 0.65 | 0.130 | 0.91 | 2.31 | 0.021 | — | — | — | — |

From the results obtained on the steel Sample Nos. 3 and 7, when examined in light of the data shown in FIG. 2 illustrating characteristics of materials which contain or do not contain Mo, it is understood that the effect produced by the addition of Co is obtainable regardless of whether Mo is contained or not. A comparison between the steel Sample No. 2 and the steel Sample No. 4 shows that addition of Co together with Al produces a greater effect in improving toughness than that produced when Co alone is added. Inclusion of Al does not cause deterioration in high-temperature strength and oxidation resistance.

It is also understood that addition of Co produces an appreciable effect in improving toughness, even in steels having a low Cr content, a high Si content and a high Nb content as is the case of steel Sample No. 8.

It will also be understood that, as will be clear when steel Sample Nos. 1 and 4 are contrasted to steel Sample Nos. 9 and 10, addition of Ti and Zr is effective in lowering the recrystallization temperature without causing reduction in high-temperature strength and oxidation resistance, thus contributing to a marked improvement in producibility.

A comparison between steel Sample No. 1 and steel Sample No. 11 shows that addition of REM (La+Ce) effectively improves oxidation resistance without causing any reduction in high-temperature strength and toughness.

TABLE 2

| No. | 0.2 PS at 900° C. (M Pa) | TOUGHNESS OF HEAT-TREATED MATERIAL EQUIVALENT TO HAZ* | RECRYSTALLIZATION TEMP (°C.) | OXIDATION WEIGHT INCREASE AFTER 50 CYCLES OF RT-900° C.** |
|---|---|---|---|---|
| | | STEEL OF INVENTION | | |
| 1 | 20 | ] | 1000 | ] |
| 2 | 21 | ] | 1000 | ] |
| 3 | 21 | ] | 1000 | ] |
| 4 | 20 | ]t | 1000 | ] |
| 5 | 20 | ] | 1000 | ] |
| 6 | 20 | ] | 1000 | ] |
| 7 | 17 | ] | 1000 | ] |
| 8 | 16 | ] | 1000 | ] |
| 9 | 19 | ] | 970 | ] |
| 10 | 21 | ] | 950 | ]t |
| 11 | 20 | ] | 1000 | ]t |
| | | COMPARISON | | |
| A | 22 | x | 1000 | ] |
| B | 21 | x | 1000 | ] |
| C | 20 | x | 1000 | ] |
| D | 22 | x | 1000 | ] |
| E | 23 | x | 1000 | ] |

*CHARPY ENERGY ABSORPTION AT 0° C. OF MATERIAL AFTER 10-MINUS HEATING AT 1250° C. BY AIR COOLING (AVERAGE ON 3 TEST PIECES)]t 150 J/cm$^2$ or HIGHER; ] 80 TO 150 J/cm$^2$; x BELOW 80 J/cm$^2$

**]t |W| ≦ 2 mg/cm$^2$; ] 2 < |W| ≦ 5 mg/cm$^2$; x 5 < |W| mg/cm$^2$

What is claimed is:

1. A ferrite steel having high-temperature strength and excellent toughness comprising a composition consisting essentially of:

C: not more than about 0.02 wt %;
Si: not more than about 2.0 wt %;
Mn: not more than about 1.0 wt %;
Cr: not less than about 6.0 wt % but not more than about 23.0 wt %;
Ni: not more than about 1.0 wt %;
Nb: not less than about 0.4 wt % but not more than about 0.65 wt %;
Co: not less than about 0.01 wt % but not more than about 0.5 wt %;
Al: not more than about 0.5 wt %;
N: not more than about 0.03 wt %;

and the balance substantially Fe and incidental inclusions.

2. A ferrite steel according to claim 1, wherein the content of Co is not less than about 0.04wt % but not more than about 0.5 wt %.

3. A ferrite steel according to claim 1, further containing not more than about 2.5 wt % of Mo.

4. A ferrite steel according to claim 1, further containing not more than about 0.5 wt % of one or both of Ti and Zr.

5. A ferrite steel according to claim 3, further containing not more than about 0.5 wt % of one or both of Ti and Zr.

6. A ferrite steel according to claim 1, further containing not more than about 0.1 wt % of REM.

7. A ferrite steel according to claim 3, further containing not more than about 0.1 wt % of REM.

8. A ferrite steel according to claim 4, further containing not more than about 0.1 wt % of REM.

9. A ferrite steel according to claim 5, further containing not more than about 0.1 wt % of REM.

10. A high temperature strength ferrite steel having excellent toughness consisting essentially of:

C: not more than about 0.02 wt %;
Si: not more than about 2.0 wt %;
Mn: not more than about 1.0 wt %;
Cr: not less than about 6.0 wt % but not more than about 23.0 wt %;
Ni: not more than about 1.0 wt %;
Nb: not less than about 0.4 wt % but not more than about 0.65 wt %;
Co: not less than about 0.01 wt % but not more than about 2.0 wt %;
Al: not more than about 0.5 wt %;
N: not more than about 0.03 wt %;

and the balance substantially Fe and incidental inclusions.

11. A ferrite steel according to claim 10, wherein the content of Co is not less than about 0.04 wt % but not more than about 0.5 wt %.

12. A ferrite steel according to claim 10, further containing not more than about 2.5 wt % of Mo.

13. A ferrite steel according to claim 10, further containing not more than about 0.5 wt % of one or both of Ti and Zr.

14. A ferrite steel according to claim 12, further containing not more than about 0.5 wt % of one or both of Ti and Zr.

15. A ferrite steel according to claim 10, further containing not more than about 0.1 wt % of REM.

16. A ferrite steel according to claim 12, further containing not more than about 0.1 wt % of REM.

17. A ferrite steel according to claim 13, further containing not more than about 0.1 wt % of REM.

18. A ferrite steel according to claim 14, further containing not more than about 0.1 wt % of REM.

* * * * *

UNITED STATES PATENT AND TRADEMARK OFFICE

CERTIFICATE OF CORRECTION

PATENT NO. : 5,350,559

DATED : September 27, 1994

INVENTOR(S) : Miyazaki et al

It is certified that error appears in the above-indentified patent and that said Letters Patent is hereby corrected as shown below:

In Column 6, line 52, please delete "]t" and substitute --⊙--.

In Column 7, line 4, please delete "]t" and subtitute --⊙:--.

In Column 8,

In Table 2,

Under the column "Toughness of Heat-Treated Material Equivalent to Haz*"
at Nos. 1-3 delete "]" and subtitute --○--;
at No. 4, delete "]t" and substitute --⊙--;
at Nos. 5-11, delete "]" and substitute --○--.

Under the column "Oxidation Weight Increase After 50 Cycles of RT-900° C.**"
at Nos. 1-9 delete "]" and substitute --○--;
at Nos. 10 and 11, delete "]t" and substitute --⊙--;
at Nos. A-E, delete "]" and substitute --○--.

Line 3 under Table 2, delete "]t" and substitute --⊙--, also delete "]" and substitute --○--.

Line 5 under Table 2, delete "]t" and substitute --⊙--, also delete "]" and substitute --○--.

Signed and Sealed this

Fifteenth Day of November, 1994

*Attest:*

Bruce Lehman

BRUCE LEHMAN

*Attesting Officer*

*Commissioner of Patents and Trademarks*